US011401076B2

(12) United States Patent
Lamkemeyer et al.

(10) Patent No.: US 11,401,076 B2
(45) Date of Patent: Aug. 2, 2022

(54) VALVE BAG AND METHOD AND SYSTEM FOR PRODUCING A VALVE BAG

(71) Applicant: Windmöller & Hölscher KG, Lengerich (DE)

(72) Inventors: Andreas Lamkemeyer, Lengerich (DE); Michael Jung, Lengerich (DE); Uwe Köhn, Lengerich (DE); Jakob Derksen, Lengerich (DE); Andreas Kleemann, Lengerich (DE)

(73) Assignee: Windmöller & Hölscher KG, Lengerich (DE)

( * ) Notice: Subject to any disclaimer, the term of this patent is extended or adjusted under 35 U.S.C. 154(b) by 0 days.

(21) Appl. No.: 16/336,775

(22) PCT Filed: Sep. 27, 2017

(86) PCT No.: PCT/EP2017/074538
§ 371 (c)(1),
(2) Date: Apr. 18, 2019

(87) PCT Pub. No.: WO2018/060275
PCT Pub. Date: Apr. 5, 2018

(65) Prior Publication Data

US 2020/0122893 A1 Apr. 23, 2020

(30) Foreign Application Priority Data

Sep. 27, 2016 (DE) ..... 102016218626.4
Oct. 18, 2016 (DE) ..... 102016220428.9

(51) Int. Cl.
*B65D 33/01* (2006.01)
*B65D 30/24* (2006.01)
(Continued)

(52) U.S. Cl.
CPC ..... *B65D 31/142* (2013.01); *B31B 70/146* (2017.08); *B31B 70/262* (2017.08);
(Continued)

(58) Field of Classification Search
CPC ..... B65D 31/142; B65D 31/08; B65D 33/01; B31B 70/262; B31B 70/146; B31B 70/85;
(Continued)

(56) References Cited

U.S. PATENT DOCUMENTS 3,085,737 A * 4/1963 Horton ..... B65D 33/01 383/101
3,309,006 A * 3/1967 Perry ..... B65D 33/01 383/100
(Continued)

FOREIGN PATENT DOCUMENTS

DE 4303894 A1 8/1994
DE 10232136 A1 1/2004
(Continued)

OTHER PUBLICATIONS

Notification of Transmittal of Translation of the International Preliminary Report on Patentability dated Mar. 28, 2019, for PCT/EP2017/074538, 9 pages.

*Primary Examiner* — Peter N Helvey
(74) *Attorney, Agent, or Firm* — Peter W. Schroen; Bret E. Field; Bozicevic, Field & Francis LLP

(57) ABSTRACT

The invention relates to a valve bag, in particular a cross-bottom valve bag, comprising a first wall and a second wall, which are joined to each other by means of side edges or side folds and by means of bottoms and which delimit a bag interior, comprising a valve, which is arranged in one of the bottoms and via which the bag interior can be filled with a filling material, and comprising venting openings in the first and/or in the second wall for venting the bag interior. At least
(Continued)

one channel is provided on the outside of at least one wall, which channel covers the venting openings and is formed at least by two parallel fastening strips and by a cover strip, the cover strip likewise comprising venting openings, and wherein the shortest path between the parallel fastening strips along the cover strip is longer than the shortest path along the at least one wall or the cover strip, and/or the parallel fastening strips consist of stretchable material.

18 Claims, 3 Drawing Sheets

(51) Int. Cl.

| | |
|---|---|
| ***B31B 70/26*** | (2017.01) |
| ***B31B 70/14*** | (2017.01) |
| ***B31B 70/85*** | (2017.01) |
| ***B65D 30/18*** | (2006.01) |
| *B31B 170/20* | (2017.01) |
| *B31B 160/20* | (2017.01) |
| *B31B 150/00* | (2017.01) |

(52) U.S. Cl.
CPC ..... *B31B 70/85* (2017.08); *B65D 31/08* (2013.01); *B65D 33/01* (2013.01); *B31B 2150/001* (2017.08); *B31B 2160/20* (2017.08); *B31B 2170/20* (2017.08)

(58) Field of Classification Search
CPC ..... B31B 2170/20; B31B 2160/20; B31B 2150/001
USPC ..... 383/102
See application file for complete search history.

(56) References Cited

U.S. PATENT DOCUMENTS

| | | | | |
|---|---|---|---|---|
| 3,708,952 | A | 1/1973 | Schulze et al. | |
| 4,074,507 | A | 2/1978 | Ruf et al. | |
| 4,106,261 | A | 8/1978 | Greenawalt | |
| 4,109,792 | A | 8/1978 | Greenawalt et al. | |
| 4,563,862 | A | 1/1986 | McElvy | |
| 4,929,459 | A | 5/1990 | Silvestrini | |
| 5,399,022 | A * | 3/1995 | Sheets | B65D 33/01 383/103 |
| 5,493,844 | A * | 2/1996 | Combrink | B65B 51/146 53/410 |
| 5,553,942 | A * | 9/1996 | Domke | B65D 77/225 383/101 |
| 5,902,046 | A * | 5/1999 | Shibata | B65D 33/01 383/102 |
| 6,021,624 | A | 2/2000 | Richison et al. | |
| 6,070,397 | A | 6/2000 | Bachhuber | |
| 6,539,691 | B2 | 4/2003 | Beer | |
| 6,986,605 | B1 | 1/2006 | Allen et al. | |
| 7,090,398 | B2 * | 8/2006 | Shibata | B65D 75/26 383/101 |
| 7,877,966 | B2 | 2/2011 | Knoke et al. | |
| 7,927,015 | B2 * | 4/2011 | Heinemeier | B65D 33/01 383/101 |
| 8,869,859 | B2 | 10/2014 | Knaak et al. | |
| 9,156,591 | B2 * | 10/2015 | Bockmann | B65D 33/01 |
| 9,555,947 | B2 | 1/2017 | Su et al. | |
| 9,873,532 | B2 | 1/2018 | Canestri et al. | |
| 10,118,736 | B2 * | 11/2018 | Grosse-Heitmeyer | B65D 33/01 |
| 2004/0084282 | A1 | 5/2004 | Hellmann et al. | |
| 2005/0281493 | A1 * | 12/2005 | Heinemeier | B65D 33/01 383/103 |
| 2007/0267414 | A1 | 11/2007 | Ewerszumrode | |
| 2008/0152266 | A1 * | 6/2008 | Bergmann | B65D 33/01 383/103 |
| 2009/0052813 | A1 * | 2/2009 | Grosse-Heitmeyer | B31B 70/00 383/101 |
| 2009/0123094 | A1 | 5/2009 | Kreymborg et al. | |
| 2012/0180435 | A1 | 7/2012 | Stelluti | |
| 2014/0205213 | A1 | 7/2014 | Beer | |

FOREIGN PATENT DOCUMENTS

| | | | |
|---|---|---|---|
| DE | 102010028394 | A1 | 11/2011 |
| DE | 102013000038 | A1 | 7/2014 |
| EP | 1910176 | B1 | 10/2008 |
| EP | 1600399 | B1 | 10/2010 |
| EP | 2991911 | B1 | 2/2017 |

* cited by examiner

VALVE BAG AND METHOD AND SYSTEM FOR PRODUCING A VALVE BAG

The invention relates to a valve bag, a method for producing a valve bag, and a system for producing a valve bag according to aspects of the disclosure.

Valve bags are those bags that are completely finished before filling and are filled subsequently via the valve so that no subsequent sealing of the bag is necessary. Such bags can be filled especially quickly and efficiently in filling machines. Filling materials in this case are often powdery materials such as, for example, construction materials, particularly cement.

The filling material is often placed into the bag, particularly blown in, while mixing with air. Thus, it must be possible to vent the bag.

The present invention relates to those valve bags described at the start comprising a first and a second wall, which are connected to one another through side edges or side folds. Bottoms, by means of which both walls are likewise connected to one another, are provided at the ends. The walls terminate the bag interior, along with the bottoms and optionally along with the side folds.

The valve is arranged in one of the bottoms; this bottom can thus be characterized as a valve bottom. The other bottom is completely closed, i.e., the bag interior is not accessible from the exterior by means of said bottom. This bottom can also be characterized as a valve-free bottom. Because the bag is vertically suspended and/or placed upright during filling, at least, wherein the valve bottom is located on the upper end, the end of the bag comprising the valve bottom can simply be characterized as "top" or "upper end." Accordingly, the second end is the "lower" or the "lower end."

In order to enable filling with simultaneous venting, venting openings are provided in the first and/or in the second wall.

A challenge is always providing high venting capacity but also designing the bag such that no filling material can escape through the venting openings, on one hand, and that no moisture can penetrate the bag interior, on the other hand. This is because escaping filling material leads to product loss or even may be hazardous to the health of persons who are wearing such filled bags for example, depending on the type of filling material. Moisture penetrating the bag interior may make the filling material unusable over the long term.

The object of the present invention is thus to propose a common bag and a production method for such bag which provides improved retention of filling material despite the large venting capacity required. Furthermore, improved protection against moisture is desirable.

The object is achieved by means of the features mentioned in the present disclosure.

Accordingly, a provision is that at least one channel is provided on the outside of at least one wall, said channel covering the venting openings and being formed at least by two parallel fastening strips and by a cover strip, the cover strip likewise comprising venting openings, and wherein the shortest path between the parallel fastening strips along the cover strip is longer than the shortest path along the at least one wall.

A channel is formed which covers the venting openings by means of a cover strip, which is arranged on the outside of at least one wall, and at least two fastening strips, with which the cover strip is attached to the wall. Thus, the air, which is placed into the bag interior with the filling material, can initially escape into the channel.

According to the invention, it is now further provided that the shortest path between the parallel fastening strips, that is the path transverse to the fastening strips, along the cover strip is longer than the shortest path along the at least one wall. This means that the cover strip is placed sloppily between the fastening strips when the area of the wall lies flatly between the fastening strips. This means that the wall may form a cavity even with the flatly lying area of the wall. It is advantageous in this case that the air can flow into this cavity via the venting holes even when the wall is bulging outward during the filling process. Furthermore, it is advantageous for the cavity and/or the channel to accommodate and store a lot of air from the interior in a short time and to discharge it, again, preferably to the environment, over a longer period of time. Due to the accommodation of a large quantity of air in the cavity, quick venting is ensured, wherein a small quantity of filling material may definitely also reach the cavity. However, a discharging of filling material to the environment is prevented. Particularly with slow escaping of the air to the environment, no filling material is carried along with it.

The same effect can be achieved with an invention alternative, in which the cover strip and/or the parallel fastening strips consist of expandable material. A cover strip with an expandable material can be used instead of a sloppy cover strip. Instead of this or in addition, at least one of the fastening strips may comprise an expandable material. An expandable material in this case may be elastic or deformable, for example extendable, as is known, for example, with films, which may be elongated with the effect of force. Due to the air escaping from the bag interior through the venting holes, the cover strip and/or the fastening strips can then be expanded such that the channel may have an enlarged volume compared to the starting condition. This again ensures that a large volume of air can be discharged from the bag interior in a short time.

In the first invention alternative, the cover strip may comprise a u-shaped fold at at least one of the fastening strips in order to store the still instilled bag flat, i.e., be folded so that its folded exterior is attached to the wall with the fastening strip. This achieves that the fastening strip can bulge out in a simple manner without its material being excessively stressed. In order to achieve the same effect, the cover strip may comprise a z-fold.

The valve bag according to the invention may comprise paper but also a material made of one or more plastics. Plastics in this case may be a foil web but also a web made of small plastic strips, particularly those plastic strips comprising an elongated polyolefin. A plastic in terms of the invention may also be a nonwoven material. The aforementioned materials may also be combined. Thus, for example, a wall of the bag may comprise two layers, wherein one layer consists of paper and the other layer consists of a plastic. The aforementioned materials may also be laminated or coated in some other manner. The cover strip in this case may consist of the same material or the same materials as the bag but may also consist of at least one material different therefrom.

The cover strip may be a separate strip, which is preferably extended in the longitudinal direction of the bag. The cover strip preferably extends over the entire longitudinal extension of the bag.

The fastening strips may be adhesive strips such as, for example, cold adhesive, hot-melt or dispersion, or extrusion strips. Particularly extrusion strips or, in other words, extrusion longitudinal weld seams offer advantages, because they are economical. However, a fastening strip may also be a joining strip, in which the wall and the cover strip are connected to one another by means of welding or sealing, particularly by means of ultrasound, infrared, or hot air welding or sealing.

The cover strip may be a separate workpiece. Alternatively or in addition, the cover strip may be an area of at least one wall which covers another area of the wall. Such a coverage area may be established through forming a tube made of a flat strip material very simply and efficiently. In this manner, the walls and the cover strip are formed as a single piece. The overlapping part then only needs to be attached to two or more fastening strips, which extend parallel to one another but are spaced apart in the transverse direction, in order to form the aforementioned channel.

It is advantageous when the bag according to the invention has a venting capacity of at least 5 $m^3/h$, particularly at least 10 $m^3/h$. This venting capacity relates to air but does not deviate significantly for other gases.

In a preferred embodiment of the invention, a provision is that the shortest path between the parallel fastening strips is at least 3% longer along the cover strip than the shortest path along the at least one wall. In this case, a sufficient storage device is provided for the air escaping from the bag interior, wherein the sloppiness of the cover strip is simultaneously kept small. This helps to prevent damage, particularly to the cover strip. A further provision is that the shortest path between the parallel fastening strips is at most 20%, particularly at most 10%, longer along the cover strip than the shortest path along the at least one wall.

In an advantageous further development of the invention, a layer made of a filter material is provided within the channel. Said filter material is used as an additional filter in order to again reduce the discharge of filling material to the environment. In particular, the filter material has small pores which provide air permeability but block filling material particles and dust from the path. Preferably, the filter material is attached to the cover strip, wherein the filter material preferably covers all venting openings of the cover strip, which are described in more detail below. The potential ways of fastening the filter material to the cover strip may be the same as those for attaching the cover strip to the wall. At least one fastening strip for the filter material in this case can coincide with a fastening strip for the cover strip. However, it is preferable for the fastening strips for the filter material to be spaced apart from the fastening strips for the cover strip, because the production of the bag is simpler, in that case. The filter material in this case may be paper or plastics, wherein they are present particularly as a nonwoven.

In another preferred embodiment of the invention, the bag interior is provided with at least one layer made of a filter material, wherein the filter material covers the venting openings here as well. The filter material may be the same filter material as has been described in connection with the cover strip. The attachment types may also be the same. Alternatively, the filter material may replace the venting openings. In other words, the at least one wall may comprise a recess in areas, which is then completely covered by the filter material.

In an advantageous embodiment of the invention, the air permeability of the venting openings in the at least one wall is greater than the air permeability of the cover strip. Essentially, even in connection with all of the previously and subsequently described features and properties of the invention, it is also possible for the cover strip to be free of venting openings and that instead the fastening strips have gaps through which the air can flow. A combination of both of the aforementioned venting options, however, is also conceivable. If the cover strip has a lower air permeability, particularly if a slow escaping of air into the environment is possible, the escaping of filling material is again reduced. A micro- or nano-perforation of the cover strip is advantageous in this context. In doing so, micro-perforations, for example with a density of from 10 to 30, particularly 13, venting openings per cubic centimeter ($cm^3$), and nano-perforations, for example with a density of from 50 to 100, particularly 64, venting openings per cubic centimeter ($cm^3$) can be differentiated from one another. The perforations can be created, for example, with essentially conical needles or with essentially cylindrical needles. The venting openings in this case are preferably small enough such that no moisture from the exterior can enter the bag and/or the channel. This is normally the case when the venting openings are less than 0.8 mm in diameter.

In a preferred embodiment of the embodiment, the venting openings of the at least one wall are spaced apart from the venting openings of the cover strip, in the longitudinal direction of the bag. This distance is preferably at least one third the height of the bag. In doing so, it is advantageous when the air from the bag interior has to travel a lengthened path in order to reach the environment. This causes moisture that could penetrate the channel not to reach the bag interior or at least to do so very slowly.

In general, the venting openings can be formed as holes or as slits. Holes in this case are often created with needles while slits can often be created with blades. In an advantageous embodiment, the slits are provided in the at least one wall in order to provide a significant venting capacity. The vending capacity can be again increased when at least two slits are at an angle to one another, particularly at a right angle (90°). The length of the slits in this case is preferably between 1 mm and 30 mm.

In an advantageous embodiment of the invention, a provision is that the venting openings in the at least one wall are spaced no more than half a bag length, particularly no more than one-third the bag length, especially preferably one-fourth the bag length away from the valve bottom. In this manner, the air, which is placed in the bag interior during filling, can escape in the upper area without hindrance. Only once the filling is almost complete does the filling material level reach these venting openings. A very high venting capacity is ensured over practically the entire filling process in this manner.

It is advantageous when the venting openings of the cover strip are spaced no more than half a bag length, particularly no more than one-third the bag length, and especially preferably one-fourth the bag length away from the valve-free bottom. In this manner, good protection from penetrating moisture is achieved, because any penetrating moisture must travel a long way to reach the interior of the bag. In this context it should be mentioned that the surface of the bag, which is equipped with venting openings, is no more than 15% of the total surface of the bag.

It is further preferable when the valve bottom comprises two bottom flaps, wherein the first bottom flap comprises parts of the cover strip, wherein, when viewed from the exterior, the second bottom flap covers the first bottom flap at least partially. This prevents moisture from reaching the channel via the bottom flap and from there reaching the bag interior, in the short path, via the venting openings in the at least one wall. Thus, moisture protection is increased.

It is also advantageous when the valve-free bottom comprises two flaps, wherein the first bottom flap comprises parts of the cover strip, wherein, when viewed from the exterior of the bag, the first bottom flap covers the second bottom flap at least partially. This can prevent moisture, which penetrates through the venting openings into the channel, from reaching the bag interior, in a short path, via the bottom flap. Thus, moisture protection is increased.

The moisture protection can be further improved when at least one bottom is covered with a bottom cover from the exterior and/or with an inner latch from the bag interior.

The aforementioned object is also achieved by means of a method.

The method according to the invention starts with a method for producing a valve bag, in which

- a flat strip is provided
- a tube with a first and a second wall is formed from flat strip
- the tube is separated into tube parts
- a bottom is formed on both ends of each tube piece, wherein venting holes are placed.

The aforementioned object is achieved according to the invention in that at least one cover strip is created on the first or the second wall, with which the venting holes are covered, wherein the cover strip is equipped with at least one fold extending in the longitudinal direction.

The same advantages are achieved with this method as have been previously described in connection with a bag according to the invention.

Thus, in order to produce a bag, with which at least one channel is provided on the outside of at least one wall, said channel covering the venting openings and being formed at least by two parallel fastening strips and by a cover strip, the cover strip likewise comprising venting openings, and wherein the shortest path between the parallel fastening strips along the cover strip is longer than the shortest path along the at least one wall, the cover strip is equipped with at least one fold extending in the longitudinal direction. This is, for example, the edge of the cover strip, which is folded once so that the edge area is then formed in double layers. The folded edge is preferably attached to the wall with the fastening strip.

In another embodiment, the cover strip is equipped with two folds, wherein the two fold directions extend opposite one another. This results in a z-fold. This means that the cover strip has three layers in the area of the fold.

The aforementioned folds are preferably created by guide sheets, along which the flat strip transported by a transport device, such as transport rollers, is moved. Pre-fold rollers and/or press-on rollers, with which the edge of the fold is pre-folded and/or the resulting fold edge is again fixed in position, are provided as well.

In another embodiment, the two aforementioned embodiments of the method according to the invention may be combined with one another.

In a preferred embodiment of the invention, venting holes are placed in the flat strip before it is processed into a tube. The placement of venting holes is very simple at this point.

This can take place, for example, using a roller, the outer periphery of which is equipped with needles and/or blades.

In an advantageous embodiment of the invention, the flat strip and the cover strip are connected to each other, particularly also before tube formation. In other words, the cover strip is a component of the flat strip and forms its actual functionality after the tube formation in that it is attached to the wall by means of two fastening strips.

In another advantageous design of the invention, a filter material is placed on the flat strip and/or on the cover strip and attached there. Preferably, the filter material is present as a strip and is unwound from a roller and applied. The fastening preferably takes place with a dispersion adhesive, with a cold adhesive, or with a hot-melt adhesive. It is advantageous in this case when the filter material is applied to the flat strip before a tube is formed from the flat strip. In this case, the placement and attaching of the filter material is particularly simple.

The aforementioned object is also achieved by means of a system for producing valve bags.

The system according to the invention starts with a system for producing valve bags, comprising:

- a providing device, particularly a roll-off device, for providing a flat strip
- tube-forming tools for forming a tube with a first and a second wall from the flat strip
- a separating device for separating the tube into tube parts
- bottom-forming devices for forming a bottom at both ends of each tube piece
- at least one perforation or cutting device for placing venting holes In order to achieve the aforementioned object, it is provided according to the invention

- that a device for creating a cover strip is provided on the first or the second wall, wherein the venting holes can be covered with the cover strip
- that a folding device is provided, with which the cover strip can be equipped with at least one fold extending in the longitudinal direction.

Further advantages, features, and details of the invention result from the subsequent description, in which various exemplary embodiments are explained in detail with reference to the figures. In doing so, the features mentioned in the claims and in the description may each individually be essential to the invention per se or for any combinations of features mentioned. Within the scope of the entire disclosure, the features, details, and advantages, which are described in connection with the method according to the invention, obviously also apply in connection with the valve bag according to the invention and vice versa, so that reference is always made or can be made mutually regarding the disclosure for the individual aspects of the invention. The features, details, and advantages, which are described in connection with the system according to the invention, also apply in connection with the valve bag according to the invention and/or the method according to the invention and vice versa such that a mutual reference is also possible here. In addition, features, which are described or have been described in connection with other features, may also be features according to the invention, including independently of these other features alone or in combination with any other features, such that mutual reference can be made to these feature combinations. The individual figures show the following:

Figure 1:
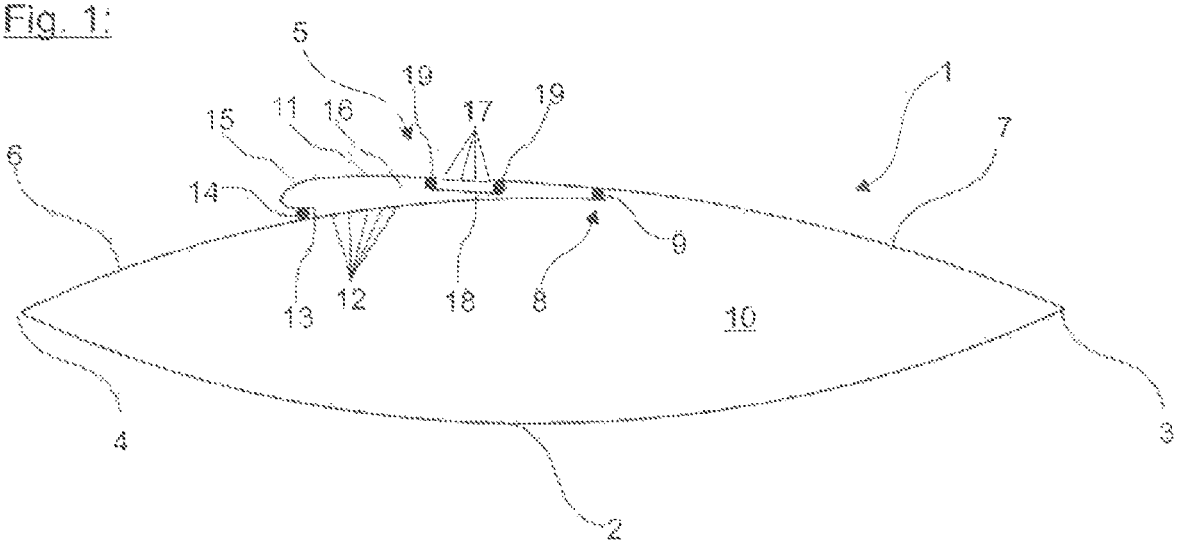
FIG. 1 is a cross-section through a first embodiment of a valve bag according to the invention.

FIG. 1 shows the cross-section through a first embodiment of a valve bag 1 according to the invention. It comprises a first wall 2, which represents the back wall in the present example. Said first wall is connected to the second wall 5, which represents the front wall, via the side edges 3, 4. The front wall 5 is formed by a first area 6 and a second area 7. The edge 8 of the first area 6 is attached at the surface facing the bag interior 10 using a fastening strip 9. The strip encroaching on the fastening strip 9 forms a cover strip 11, which covers the venting holes 12 of the second wall 5. The edge 13 of the cover strip 11 is connected on the outer surface of the first area 6 of the second wall 5 by means of a fastening strip 14. In this case, the outer surface of the cover strip is attached to the first area 6 such that a u-shaped fold 15 is formed or a double-layer area of the cover strip is formed when it is in the flat state. In this manner, a channel 16 is formed, the volume of which can be modified within a very large range. Said channel further comprises venting holes 17 so that the air from the bag interior that reaches the channel can be released to the environment.

The fastening strip 9 functions to delimit the cover strip 11 from h area 7 of the front wall 5.

A filter material 18, which is attached to the cover strip by means of two fastening strips 19, is preferably provided on the surface of the cover strip 11 facing the channel.

Figure 2:
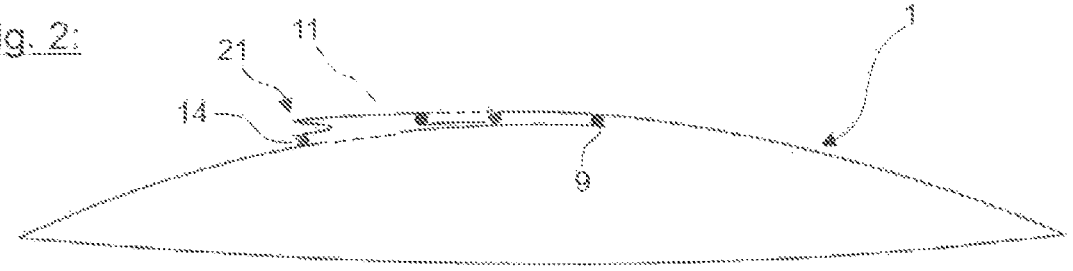
FIG. 2 is a cross-section through another embodiment of a valve bag according to the invention.

FIG. 2 shows another exemplary embodiment of a valve bag 1 according to the invention. Instead of the u-shaped fold in the cover strip 11, a z-shaped fold 21 is provided in this exemplary embodiment, said fold resulting such that a double fold is created. The z-shaped fold is characterized in that three layers are formed in this case. Even if FIG. 2 shows that the z-shaped fold 21 is arranged in the area of fastening strip 14, the z-shaped fold can be arranged at any position between fastening strip 9 and fastening strip 14. Multiple z-shaped folds 21 are also conceivable.

Figure 3:
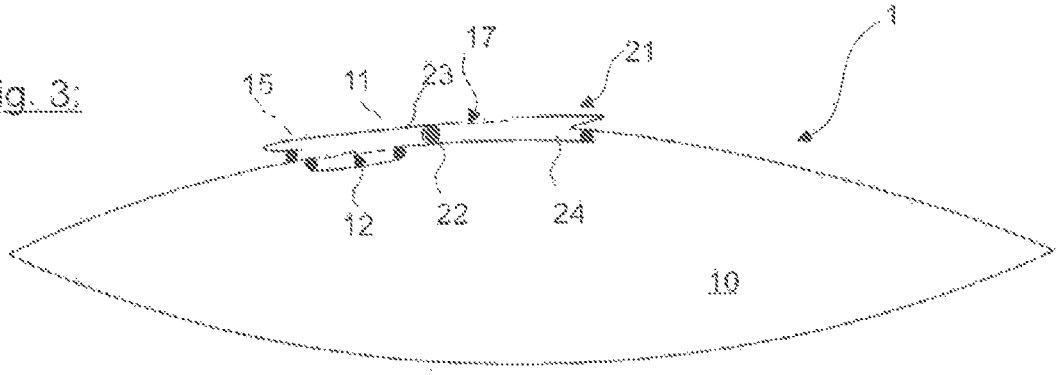
FIG. 3 is a cross-section through another embodiment of a valve bag according to the invention.

In the embodiment from FIG. 3, the cover strip 11 of the valve bag 1 even comprises a z-shaped fold 21 and a u-shaped fold 15.

The features of the exemplary embodiments according to FIGS. 1 to 3 may be combined as desired. However, in all cases, it is important that the length of the path that is established by the line, visible in the figures, of the cover strip 11 between fastening strip 9 and fastening strip 14 is greater than the length of the path that is established by the line, visible in the figures, of the second wall 5 between fastening strip 9 and fastening strip 14. It is preferable here when the length difference is at least 3%.

FIG. 3 shows another embodiment option, which can also be combined with all of the other exemplary embodiments disclosed in this patent application. In this case, the cover strip 11 is attached to the area 6 of the front wall with a third fastening strip 22. Said third fastening strip 22 divides the channel 16 into a first sub-channel 23 and a second sub-channel 24, wherein the venting holes 12 lead from the bag interior 10 to the first sub-channel 23. The venting openings 17 then lead from the second sub-channel 24 to the environment. To ensure that the air from the first sub-channel 23 can then reach the second sub-channel 24, the fastening strip comprises at least one gap. Preferably, the at least one gap is long enough such that the venting capacity of the bag is not impacted.

Figure 4:
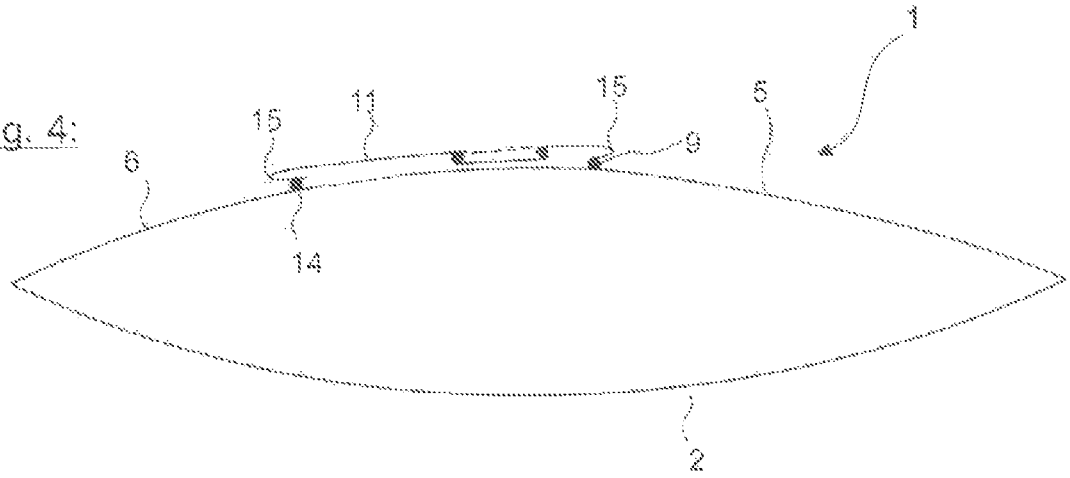
FIG. 4 is a cross-section through another embodiment of a valve bag according to the invention.

In contrast with the exemplary embodiments according to FIGS. 1 to 3, the cover strip 11 is formed as a separate workpiece in the exemplary embodiment according to FIG. 4. Accordingly, it is not formed in one piece with a part of the front wall 5. This separate cover strip 11 is attached on the front wall 5 of the valve bag by means of two fastening strips 9, 14. As the example shows, the cover strip 11 comprises u-shaped folds 15 at its two edges. The front wall 5 and the back wall 2 of the valve bag 1 may already be produced as a tube, for example by means of a blown film extrusion process or a circular weaving process. However, a tube may also be produced from a flat strip, in which the two side areas have been folded with the formation of an overlap and in which the overlapping edges are connected by means of a weld seam.

Figure 5:
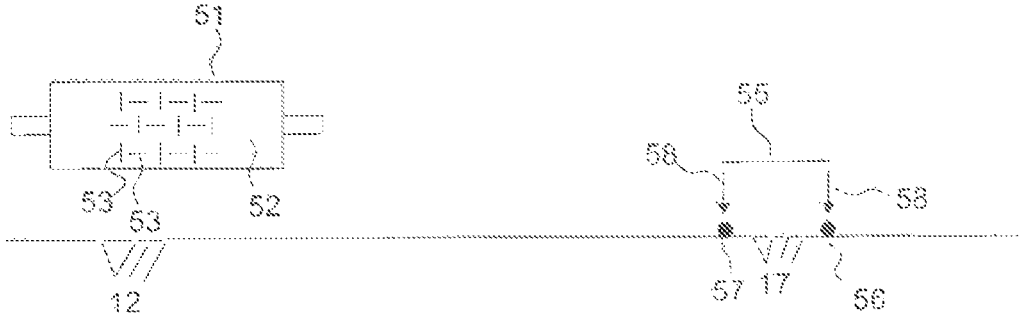
FIG. 5 shows the processing of a flat strip before tube formation.

FIG. 5 then shows some steps of a method according to the invention for producing a valve bag. To this end, a flat strip 50 is initially unrolled by a roll-off device, which is not shown. Subsequently, the venting openings 17 are placed, which are also not shown. Said venting openings are preferably not placed in the longitudinal direction of the flat strip continuously but rather in cycles. To this end, a roller, the peripheral surface of which is prepared with needle, cutting, or punching tools, can be unrolled on the flat strip. An alternative or additional provision may be that such a roller is placed in contact with the flat strip 50 at the points on which venting openings 17 are intended to be placed. To this end, an actuating mechanism may be provided, which places the roller in contact with the flat strip in cycles. The flat strip preferably runs by means of a mating-roller in this case.

The venting openings 12 can be placed in the flat strip 50 in the same manner. In this case however, a roller 51 is shown with which individual, short sections are created in the flat strip 50. The circumferential surface 52 of the roller 51 is provided with blades 53 for this, wherein every two adjacent blades form an angle to one another, particularly a right angle. An actuating mechanism, which places the roller in contact with the flat strip in cycles, may be provided as well for the roller 51. The actuating mechanism for the roller 51 functions independently of the actuating mechanism mentioned in the previous paragraph, because the venting openings, 12 and 7, are preferably placed offset in transport direction of the flat strip.

After placement of venting holes 17 and before or after the placement of venting holes 12, the flat strip 50 is provided with a filter material 55, which is attached to the flat strip 50. Said filter material may be applied to the flat strip in the form of a strip. To this end, the filter material may be provided as a roller and be unrolled within a roll-off device. In order to attach the filter material, a provision may be that the filter material is provided with two lateral adhesive strips in its roller form. It is advantageous, however, when two adhesive tracks 56, 57 are applied to the flat strip and/or to the strip-shaped filter material, wherein the venting openings 17 lie completely within said adhesive tracks. The adhesive tracks may comprise a dispersion adhesive, a hot-melt adhesive, or a cold adhesive; however, they may also comprise an extrudate. In the latter case, plastic in an extruder is transitioned to a melt form and applied as tracks through tubes in this form. Directly after application of the adhesive tracks, the flat strip and the strip-shaped filter material are combined, which is indicated by arrows 58, and pressed together, for example by means of a pair of pressing rollers, and optionally cooled as well.

In another embodiment, the filter material 55 may also be applied to the flat strip in form of slips, wherein the filter material should be dimensioned such that it completely covers the venting openings 17 concentrated on a section of surface. In order to provide the filter material in form of slips, prefabricated slips can be used. However, it is preferable when the filter material is present in roller form and is separated into slips by means of a separating tool, for example a cutting tool. Adhesive tracks are then preferably applied to the flat strip 50, wherein a circumferential adhesive track is created so that the air, which should go through the filter material, cannot escape through a gap in the adhesive track.

The described procedures for applying filter material may also be used when the venting openings 12 are to be covered with a filter material.

Figure 6:
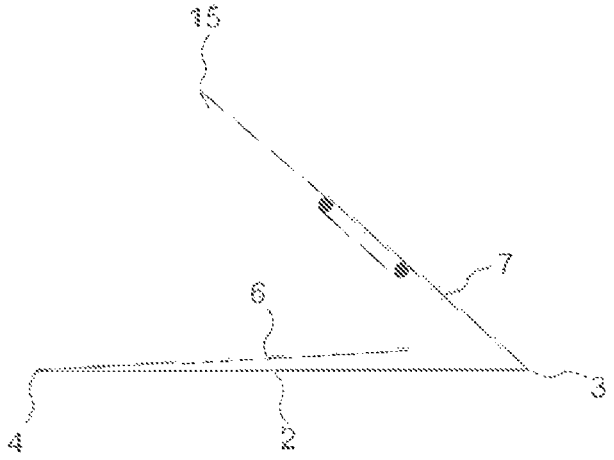
FIG. 6 shows the formation of a tube from the flat strip.

FIG. 6 next shows the folding of the side areas of the flat strip 50 around the edges of the fold, 3 and 4, wherein the back wall 2 and the two areas, 6 and 7, of the front wall 5 are formed. In doing so, it is advantageous when area 6 is already more folded at a fixed position than area 7. The u-shaped fold 15 is preferably created before or even during the folding of area 7. Alternative or additional folds may also be placed at this time. However, it is also possible for the described folds to be placed after folding of areas 6 and 7.

Figure 7:
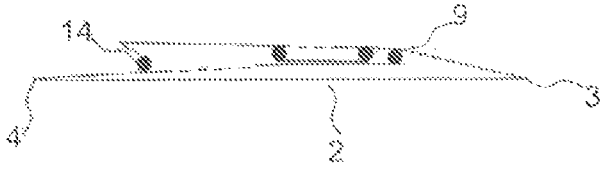
FIG. 7 shows the tube completely finished.

FIG. 7 shows the already folded areas 6 and 7, which are then attached to one another with fastening strips 9 and 14. To this end, there are two extrusion tubes, which place at least one melted plastic material in the form of at least two parallel tracks between areas 6 and 7 and thus delimit channel 16. Using at least one pressing device, which is not shown, for example a press-on roller, areas 6 and 7 can be connected to one another along fastening strips 9 and 14 such that a permanent and long-term connection can be created. At least one cooling device may be provided in order to cool down the fastening strips, particularly when they were created with the development of heat. The cooling device may consist of the pressing device. Thus, for example, press-on rollers may be cooled.

Figure 8:
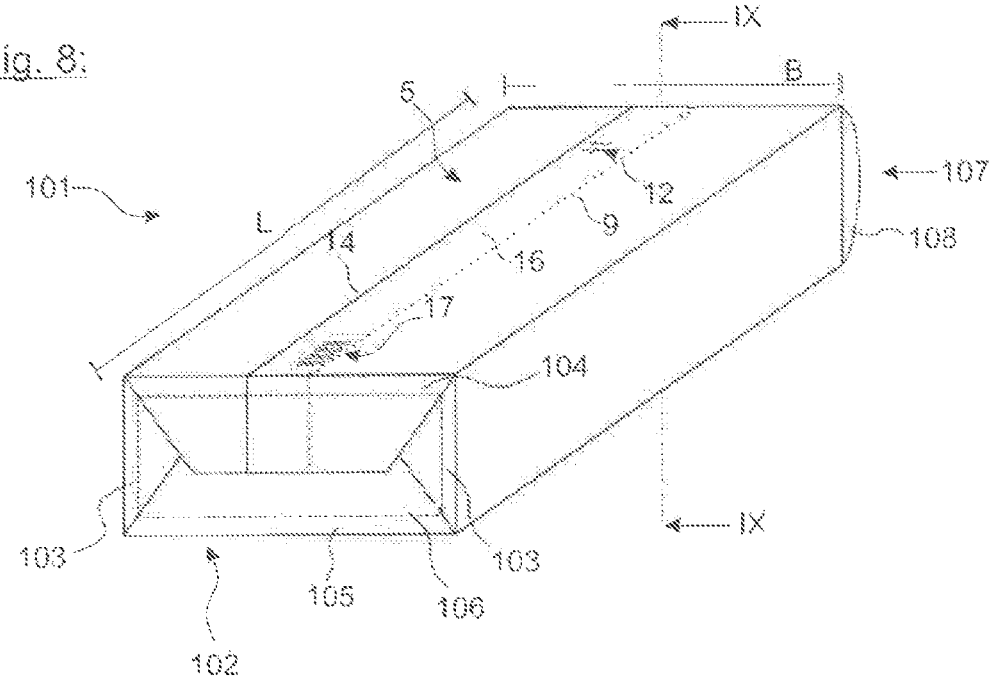
FIG. 8 shows a perspective view of a valve bag according to the invention.

FIG. 8 next shows a valve bag 101, characterized simply as bag, which preferably is produced from a tube according to the exemplary embodiments in FIGS. 1 to 7. In order to produce a bag 101 from such a tube, said tube is separated into tube pieces, a bottom opening is formed at both its ends, and subsequently said bottom opening is sealed forming one bottom. In the exemplary embodiment shown, the bottoms, of which only one bottom 102 can be seen, are formed as cross-bottoms. To this end, during production, one bag end is fitted by forming a bottom rectangle and two bottom triangles 103. Subsequently, the side latches, 104 and 105, are folded over such that they partially overlap. Preferably, a bottom cover sheet 106 is subsequently affixed to the already-formed bottom, wherein it is preferably connected with both bottom triangles 103 and with both side latches 104 and 105.

The non-visible bottom 107 is formed similarly to bottom 102; however, a valve 108 is placed on one of the two bottom triangles and fastened there, before folding of side latches 104 and 105, such that the side latches are folded by means of the valve. Alternatively, a valve slip can be placed on one of the bottom triangles and fastened there, said valve slip forming the valve 108 by means of the folding of the side latches. The optional bottom cover sheet is subsequently connected only with the valve and not with the bottom triangle underneath. The valve 108 ensures access from the environment to the bag interior and thus offers the option of filling the bag with filling material from the outside. In one further development of the shown embodiment, a provision is that the valve 108 is formed to be sealable in order to reduce the penetration of moisture and the escaping of parts of the filling material after filling, during subsequent storage. With reference to valve 108, the bottom 107 can be characterized as a valve bottom, while bottom 102 can be characterized as a valve-free bottom.

It is further discernible that the second wall 5 continues into side latch 104, which is preferably folded via side latch 105. The advantages of this embodiment are explained below in connection with FIG. 9. As previously explained, the wall 5 comprises the channel 16, which is delimited by fastening strips 9 and 14, wherein fastening strip 9 is represented by a dashed line, because it is not visible in a finished bag. It is further discernible that venting openings 17 are arranged closer to the valve-free bottom than venting openings 12. Preferably, the distance between the venting openings 17 and the bottom 102 is no more than one-third, preferably no more than one-fourth, particularly one-fifth the entire bag length L.

Conversely, a provision is that venting openings 17 are arranged closer to the valve bottom than venting openings 12. Preferably, the distance between the venting openings 12 and the bottom 107 is no more than one-third, preferably no more than one-fourth, particularly one-fifth the entire bag length L.

Figure 9:
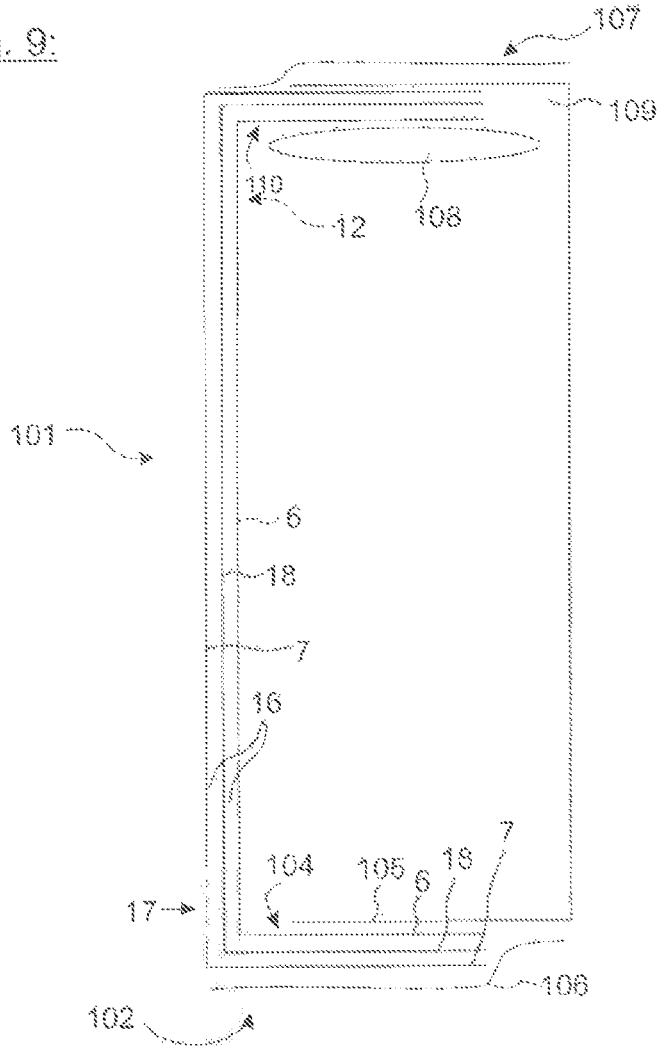
FIG. 9 shows section IX-IX from FIG. 8.

FIG. 9 shows section IX-IX through the bag 101 (see FIG. 8). Thus, sections through bottoms 102 and 107 are now discernible. With the valve-free bottom 102, particularly the folding sequence of side latches 104 and 105 is discernible. Because section IX-IX also forms a section through the channel 16, the side latch 104 appears in three layers, because, in addition to the relevant parts of areas 6 and 7, the filter material 18 is discernible, as well. Side latch 104 is enclosed, i.e., it was folded before the folding of side latch 105. Thus, side latch 105 is on the exterior. Because of the bottom cover sheet 106, the channel 16 is not accessible or barely accessible via latch 105 such that practically no moisture can penetrate the bag via bottom 102. However, if there is moisture nonetheless, this moisture must first be diffused over the entire bag length in order to reach the bag interior.

The valve bottom 107 comprises side latches 109 and 110, wherein side latch 109 is form similarly to side latch 105. Accordingly, side latch 110 is formed analogously to side latch 104. In contrast to bottom 102, the side latch 110 is initially folded with bottom 107, i.e., it is enclosed. Side latch 109 consequently forms the external latch. Because the valve 108 is additionally arranged underneath side latch 110 and, at least during filling, the individual layers of the side latches are pressed together, part of the filling material is prevented from reaching the channel 16.

LIST OF REFERENCE NUMERALS

1 Valve bag
2 First wall
3 Side edge
4 Side edge
5 Second wall
6 First area
7 Second area
8 Edge
9 Fastening strip
10 Surface
11 Cover strip
12 Venting holes
13 Edge
14 Fastening strip
15 u-shaped fold
16 Channel
17 Venting opening
18 Filter material
19 Fastening strip
20
21 z-shaped fold

22 Fastening strip
23 First sub-channel
24 Second sub-channel
50 Flat strip
51 Roller
52 Circumferential surface
53 Blade
55 Filter material
56 Adhesive track
57 Adhesive track
58 Arrow
101 Valve bag
102 Bottom
103 Bottom triangle
104 Side latch
105 Side latch
106 Bottom cover sheet
107 Nonvisible bottom
108 Valve
109 Side latch
110 Side latch
L Bag length

The invention claimed is:

1. A valve bag, in particular a cross-bottom valve bag, comprising:

a first wall and a second wall, which are joined to each other by means of side edges or side folds and by means of bottoms and which delimit a bag interior, a first side latch and a second side latch, wherein the first and second side latches are folded over such that they partially overlap, a valve, which is arranged in one of the bottoms and via which the bag interior can be filled with a filling material, and venting openings in the second wall for venting the bag interior, wherein:

at least one channel is provided on the outside of the second wall, said channel covering the venting openings and being formed at least by two parallel fastening strips and by a cover strip comprising an outer surface, the cover strip likewise comprising venting openings within the outer surface, the venting openings in the at least one wall are no more than half a bag length away from the bottom in which the valve is arranged, the venting openings of the cover strip are no more than half a bag length away from the bottom in which no valve is arranged, the second wall continues into the first side latch, and the shortest path between the parallel fastening strips along the cover strip is longer than the shortest path along the at least one wall, or the cover strip and/or the parallel fastening strip consist of an expandable material, and the cover strip comprises a u-shaped or a z-shaped fold.

2. The valve bag according to claim 1, wherein the shortest path between the parallel fastening strips is at least 3% longer along the cover strip than the shortest path along the at least one wall.

3. The valve bag according to claim 1, wherein the venting capacity is greater than 5 $m^3/h$ and particularly greater than 10 $m^3/h$.

4. The valve bag according to claim 1, wherein a layer comprising a filter material is provided within the channel.

5. The valve bag according to claim 1, wherein a layer comprising a filter material is provided in the bag interior, wherein the filter material covers the venting openings in the outer surface of the cover strip.

6. The valve bag according to claim 1, wherein the air permeability of the venting openings in the at least one wall is greater than the air permeability of the cover strip.

7. The valve bag according to claim 1, wherein the venting openings in the at least one wall are no more than one-third the bag length away from the bottom in which the valve is arranged.

8. The valve bag according to claim 1, wherein the venting openings of the cover strip are no more than one-third the bag length away from the bottom in which no valve is arranged.

9. The valve bag according to claim 1, wherein the valve bottom comprises two bottom flaps, wherein the first bottom flap comprises parts of the cover strip, wherein, when viewed from the exterior, the second bottom flap covers the first bottom flap at least partially.

10. The valve bag according to claim 1, wherein the bottom, which is valve-free, comprises two bottom flaps, wherein the first bottom flap comprises parts of the cover strip, wherein, when viewed from the exterior of the bag, the first bottom flap covers the second bottom flap at least partially.

11. A method for producing a valve bag according to claim 1, wherein a flat strip is provided a tube with a first and a second wall is formed from the flat strip, the tube is separated into tube parts, a bottom is formed on both ends of each tube piece, the valve bag comprises a first side latch and a second side latch, wherein the first and second side latches are folded over such that they partially overlap, and wherein venting openings are placed, wherein:

at least one cover strip is created on the first or the second wall, with which the venting openings are covered, wherein the cover strip comprises an outer surface likewise having venting openings and is equipped with at least one u-shaped or z-shaped fold extending in the longitudinal direction, the venting openings in the at least one wall are no more than half a bag length away from the bottom in which the valve is arranged, the venting openings of the cover strip are no more than half a bag length away from the bottom in which no valve is arranged, and at least one channel is provided on the outside of the second wall, and the second wall continues into the first side latch.

12. The method according to claim 11, wherein the venting openings are placed before a tube is formed from the flat strip.

13. The method according to claim 11, wherein the cover strip is formed from the flat strip, wherein the cover strip and the flat strip are connected to each other.

14. The method according to claim 11, wherein a filter material is applied to the flat strip and/or to the cover strip and attached therein.

15. The method according to claim 11, wherein a filter material is applied to the flat strip and/or to the cover strip and attached therein.

16. A system for producing a valve bag according to claim 1, comprising a providing device, particularly a roll-off device, for providing a flat strip, tube-forming tools for forming a tube with a first and a second wall from the flat strip, a separating device for separating the tube into tube parts, bottom-forming devices for forming a respective bottom at both ends of each tube piece, and at least one perforation or cutting device for placing venting openings, wherein that a device for creating a cover strip is provided on the first or the second wall, wherein the venting openings can be covered with the cover strip, that a folding device is provided, with which the cover strip comprising an outer surface likewise having venting openings can be equipped with at least one u-shaped or L-shaped fold extending in the longitudinal direction.

17. The valve bag according to claim 1, wherein the cover strip comprises a u-shaped fold.

18. The valve bag according to claim 1, wherein the cover strip comprises a z-shaped fold.

* * * * *